US007036162B1

(12) United States Patent
Gatten

(10) Patent No.: US 7,036,162 B1
(45) Date of Patent: May 2, 2006

(54) COOLING MATTRESS FOR SUNBATHING

(76) Inventor: Kenneth W. Gatten, 409 Fifth St., New Cumberland, PA (US) 17070

( * ) Notice: Subject to any disclaimer, the term of this patent is extended or adjusted under 35 U.S.C. 154(b) by 0 days.

(21) Appl. No.: 10/659,186

(22) Filed: Sep. 10, 2003

(51) Int. Cl.
*A47C 21/04* (2006.01)
*A47C 27/10* (2006.01)

(52) U.S. Cl. ..... 5/421; 5/420; 5/722; 5/655.5; 5/909

(58) Field of Classification Search ..... 5/417, 5/419–421, 722, 723, 691, 654, 655.5, 644, 5/909, 922
See application file for complete search history.

(56) References Cited

U.S. PATENT DOCUMENTS 3,284,819 A * 11/1966 Nissen ..... 5/420
3,555,581 A * 1/1971 Friant ..... 5/705
4,459,714 A * 7/1984 Lin ..... 5/655.3
4,533,050 A * 8/1985 Bake, Jr. ..... 206/545
4,788,730 A * 12/1988 Bexton ..... 5/676
4,824,411 A * 4/1989 McClanahan ..... 441/129
4,908,887 A * 3/1990 Shaw, Jr. ..... 5/419
5,066,001 A * 11/1991 Wilkinson ..... 482/52
5,086,529 A * 2/1992 DeGroot ..... 5/710
5,101,823 A * 4/1992 Smith ..... 607/81
5,388,295 A * 2/1995 Sarkozi ..... 5/630
5,632,051 A * 5/1997 Stanley et al. ..... 5/636
5,800,480 A * 9/1998 Augustine et al. ..... 607/96
5,837,002 A * 11/1998 Augustine et al. ..... 607/104
5,991,948 A * 11/1999 Stanley et al. ..... 5/709
6,033,432 A * 3/2000 Augustine et al. ..... 607/96
6,128,795 A * 10/2000 Stanley et al. ..... 5/421
6,132,455 A * 10/2000 Shang ..... 607/108
6,210,427 B1 * 4/2001 Augustine et al. ..... 607/96

* cited by examiner

*Primary Examiner*—Robert G. Santos
(74) *Attorney, Agent, or Firm*—Hooker & Habib, P.C.

(57) ABSTRACT

A cooling mattress for supporting and cooling a sunbather while sunbathing includes a number of pads joined by a number of fasteners. Each pad includes a liner defining a cavity and a cooling medium deposited within the cavity. The fasteners interconnect the pads to one another so that the connected pads cooperatively form a surface for supporting a sunbather lying or sitting on the surface of the mattress. The cooling medium cools the sunbather while sunbathing.

7 Claims, 3 Drawing Sheets

COOLING MATTRESS FOR SUNBATHING

FIELD OF THE INVENTION

The invention relates to a mattress for sunbathing. Particularly, the present invention is directed to a mattress that cools the sunbather while sunbathing.

DESCRIPTION OF THE PRIOR ART

Sunbathing is a popular activity for those seeking a natural suntan or for those who merely enjoy being outside in the sunshine. Sunbathers often lie on portable air or foam mattresses while sunbathing. The mattresses provide cushioned support that enables the sunbather to lie in comfort for hours under the sun.

The heat of the sun and the warmth of the air, however, can cause sunbathers to overheat and become uncomfortable. They cut short their sunbathing sessions and seek relief from the heat in the shade, or even move inside and stop enjoying the outdoors altogether.

Conventional portable mattresses do not help cool sunbathers lying on them. The mattresses do not provide any relief from the heat and often become uncomfortably hot themselves.

Pillows are known that contain cooling elements. Although sunbathers can use these pillows to support their heads while sunbathing, their usefulness is limited. The pillows are designed to support only the head and cannot cool the rest of the body.

Therefore, there is a need for a cooling mattress that comfortably supports a sunbather while cooling the sunbather and maintaining a comfortable body temperature. Such a mattress would enable sunbathers to extend their sunbathing sessions and enjoy being outdoors in the sun despite the heat.

SUMMARY OF THE INVENTION

The present invention is a cooling mattress that comfortably supports a sunbather while cooling the sunbather and maintaining a comfortable body temperature. The mattress enables sunbathers to extend their sunbathing sessions and enjoy being outdoors in the sun despite the heat.

A mattress in accordance with the present invention includes a flexible liner that defines at least one cavity surrounded by the liner. Each cavity is filled with a resilient cooling medium. The liner has an outer surface configured to support a sunbather lying or sitting on the mattress.

Before use, the mattress is chilled or refrigerated to lower the temperature of the cooling medium. The sunbather lays or sits on the chilled mattress while sunbathing. The resilient cooling medium comfortably supports and cools the sunbather, absorbing heat from the sunbather and maintaining the sunbather at a comfortable body temperature.

In a preferred embodiment of the present invention, the liner is constructed from a number of individual pads. Each pad has a cavity that contains and encapsulates the cooling medium. The cooling medium is preferably a conventional gel, such as a single phase change material (PCM), used for controlling the temperature of products. The cooling medium acts at both a refrigerant and a cushioning material for the user.

In alternative embodiments a liquid cooling medium, such as an alcohol/water mixture preferably having a freezing point below the freezing point of water, can be used.

Pads are preferably joined together by permanent connectors, detachable connectors, or a combination of both. Detachable connectors enable the pads to be separated to facilitate chilling the mattress in a refrigerator or freezer. The pads can also be rearranged or separated to form child-size mattresses or for being placed on lounging chairs or other outdoor furniture. The pads can also be assembled together to form longer or wider mattresses.

With either the permanent or detachable connectors, the cooling mattress can be folded into a compact shape to be chilled in a refrigerator or freezer. The compact shape also makes it easier to bring the mattress to the beach, and the folded mattress can be carried in an insulated carrying bag to keep the mattress chilled before use.

The cooling mattress of the present invention enables sunbathers to remain cool and comfortable under the sun for a longer period of time. The mattress easily folds to be chilled in a refrigerator or freezer, and can be conveniently carried in an insulated carrying bag. In addition to being the perfect accessory for toting to the beach, pool, or suntanning booth, the cooling mattress can be used to relax sore and tired body parts or to soothe strained muscles.

Other objects and features of the invention will become apparent as the description proceeds, especially when taken in conjunction with the accompanying 3 drawing sheets illustrating four embodiments of the invention.

DESCRIPTION OF THE PREFERRED EMBODIMENTS

Figure 1:
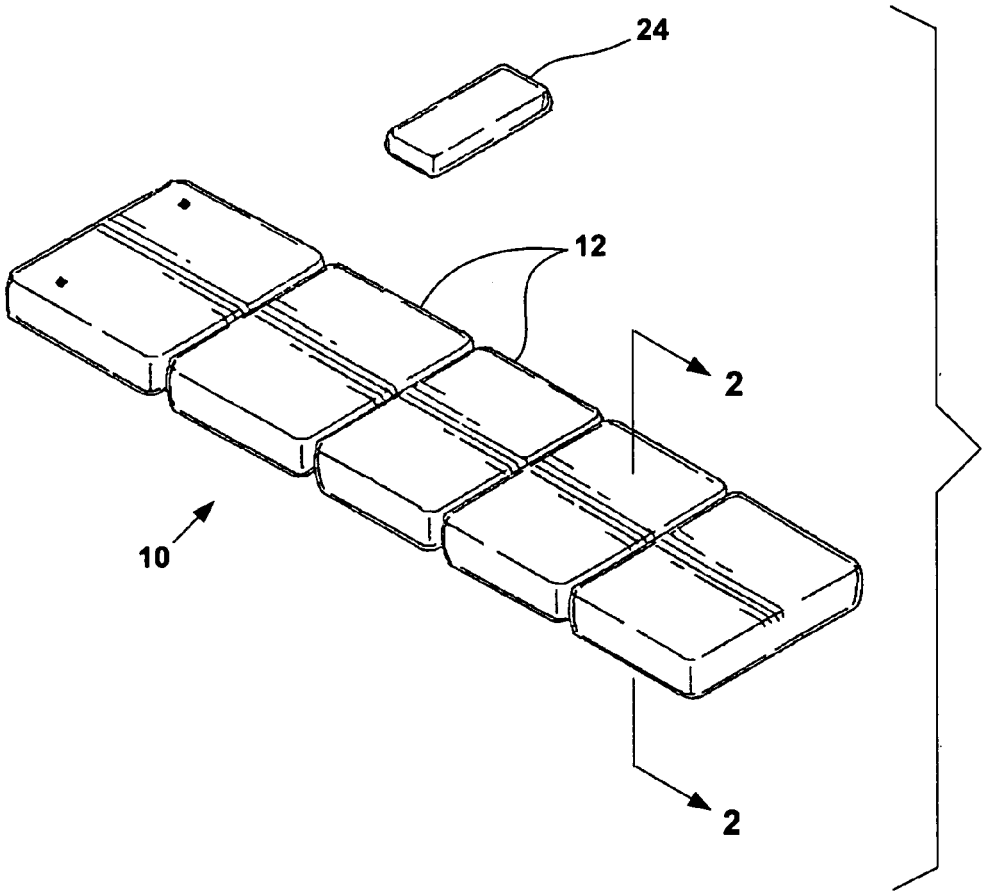
FIG. 1 is a perspective view of a first embodiment mattress in accordance with the present invention.
Figure 2:
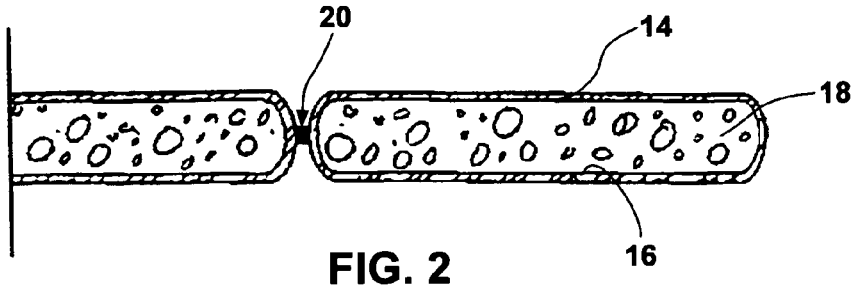
FIG. 2 is a cross section view of the mattress shown in FIG. 1 taken along line 2—2 of FIG. 1.
Figure 3:
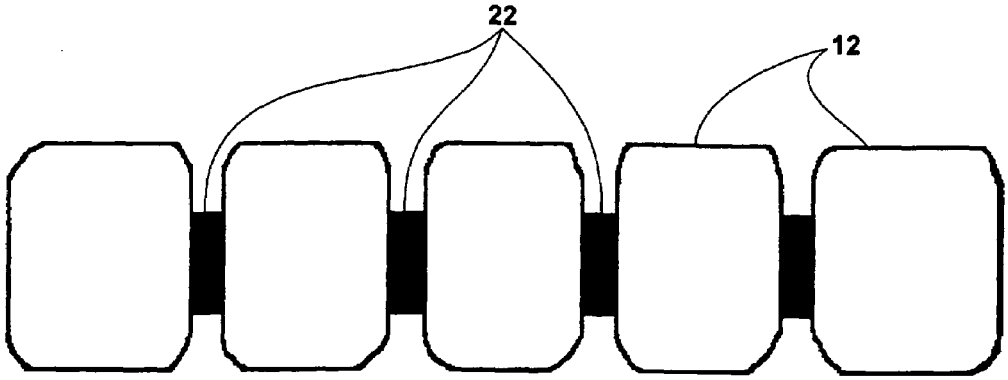
FIG. 3 is a schematic top view of the mattress shown in FIG. 1.

FIGS. 1–3 illustrate a first embodiment mattress 10 in accordance with the present invention. The mattress 10 is made up of a number of pads 12. Each pad is comprised of a liner 14. The liner is formed from a sturdy, flexible material, such as plastic or vinyl, that can withstand contact with abrasive substances such as soil, rocks or sand and yet can conform to the shape of a body resting on the mattress.

Each pad 12 defines an interior cavity 16. Each cavity is filled with a cooling medium 18. Cooling medium 18 is a conventional viscous refrigerant gel, preferably a single phase change material (PCM) that maintains a relatively constant temperature at or below the freezing point of water while changing phase. An example of such a material is disclosed in Malach, U.S. Pat. No. 6,482,332, which patent is incorporated by reference as if fully set forth herein. Other cooling gels or cooling mediums can be used.

In other possible embodiments the cooling medium is a water/alcohol solution preferably having a freezing point lower than the freezing point of water. Cooling mediums that maintain a substantially constant temperature above the freezing point of water can also be used.

Pads 12 are connected to one another by a set of fasteners 20. In this embodiment fasteners 20 are formed from a number of permanent cloth or plastic connectors 22 that permanently connect the pads to one another. Each connector 22 joins a respective pair of pads, with the ends of the connectors sewn to the pads or attached to the pads by adhesive.

FIG. 3 illustrates the pads 12 arranged to form the mattress 10. In the illustrated embodiment the mattress includes five pads 12, with one or more connectors 22 connecting adjacent pairs of pads. Each pad 12 has a generally rectangular shape preferably about 15 inches to 18 inches wide and about 10 inches to 12 inches long, and has a thickness of about 1 inch to about 1½ inches. The pads 12 are arranged in a single row extending along the length of the pads, forming a mattress intended to support one adult sunbather.

The shape, thickness and number of pads can vary in other embodiments. It is within the scope of the invention for mattresses to be sized for children or for supporting more than one adult.

A pillow 24 (see FIG. 1) is detachably attached to one pad 12 to support the sunbather's head. The pillow is preferably attached to the pad by conventional hook and loop fasteners (not shown). The pillow can also include cooling medium like cooling medium 18 if desired.

Figure 4:
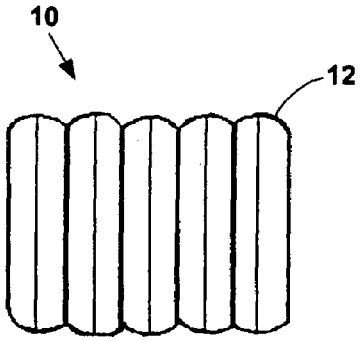
FIG. 4 is a view of the mattress shown in FIG. 1 folded to compact the mattress.

FIG. 4 illustrates the mattress 10 folded in a compact configuration for storage, chilling, or transport. The connectors 22 are flexible for folding and sized to enable the mattress to be folded with the pads facing one another as shown in the figure. This compact configuration enables the mattress to be placed in a refrigerator or freezer to chill the mattress prior to use.

Figure 5:
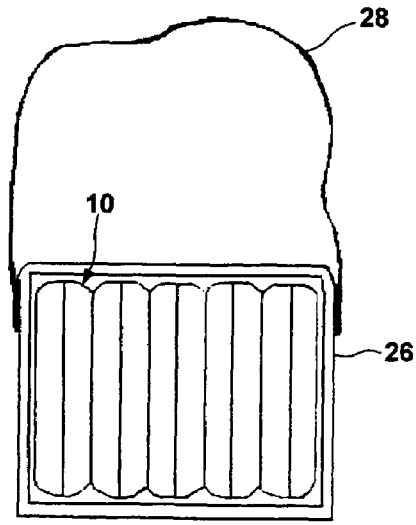
FIG. 5 is a view of the compacted mattress shown in FIG. 4 in a carrying case.

FIG. 5 illustrates the folded mattress 10 stored in an insulated bag or carrying case 26 having a carrying strap 28. The case 26 conveniently holds the mattress for transport and helps keep the chilled mattress cool before use.

For use, the mattress is chilled to a temperature substantially below the expected ambient temperature. Preferably the mattress is folded and then chilled to below the freezing point of water. The cooling gel 18 maintains its gel-like viscosity despite being chilled. The cooled mattress is placed in the carrying case 26 and taken to where it will be used.

After being removed from the case, the mattress is unfolded for use. A towel or other covering is placed over the mattress to prevent direct contact of the skin against the chilled mattress. The sunbather lies or sits on the mattress and the mattress cools the sunbather by transferring heat from the sunbather to the cooling medium 18. The cooling medium 18 preferably maintains a substantially constant temperature while absorbing heat.

Figure 6:
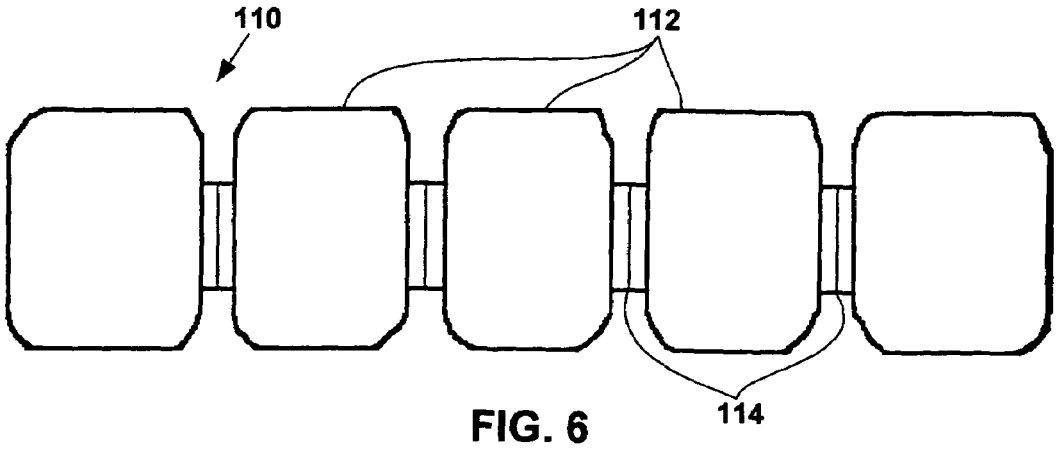
FIG. 6 is a schematic top view of a second embodiment mattress in accordance with the present invention.

FIG. 6 illustrates a second embodiment cooling mattress 110 in accordance with the present invention. Mattress 110 is similar to mattress 10 except that the adjacent pairs of pads 112 are connected to one another by detachable connectors 114. The illustrated connectors 114 are hook and loop fasteners, with the hook portion attached to one pad and the loop portion attached to the other pad. Other detachable connectors that could be used in alternative embodiments include snaps, buttons, and the like.

The detachable connectors 114 enable the pads to be separated whereby the mattress can in effect be folded into the compact configuration previously described. The connectors 114 also enable the number of pads to be used along the length of the mattress to vary with the needs of the user. The pads can also be separated for chilling in different refrigerators or freezers.

Figure 7:
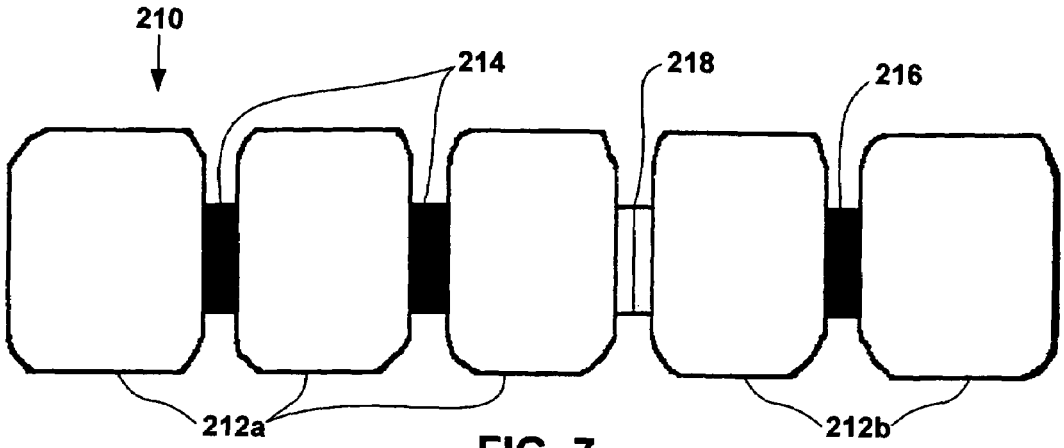
FIG. 7 is a schematic top view of a third embodiment mattress in accordance with the present invention.

FIG. 7 illustrates a third embodiment mattress 210 in accordance with the present invention. Mattress 210 is similar to mattress 10 and mattress 110 except that the pads are divided into a first set of three pads 212*a* and a second set of two pads 212*b*. Adjacent pairs of pads 212*a* are connected to each other by permanent connectors 214 similar to connectors 22. Adjacent pairs of pads 212*b* are also connected to each other by permanent connectors 216 similar to connectors 22. The set of pads 212*a* is detachably connected to the set of pads 212*b* by detachable connectors 218 similar to connectors 114.

The different combinations of permanent and detachable fasteners 214–218 allow the user to assemble the mattress 210 in a variety of additional configurations. These include separating the mattress at the detachable connectors 218 to form a three-pad mattress made of pads 212*a* and a two-pad mattress made of pads 212*b*. The three-pad mattress is preferably sized so that one pad forms a seat rest and the other two pads form a backrest when the three-pad mattress is placed over a lawn chair. The two-pad mattress can be used by a child or can be used in smaller chairs.

Figure 8:
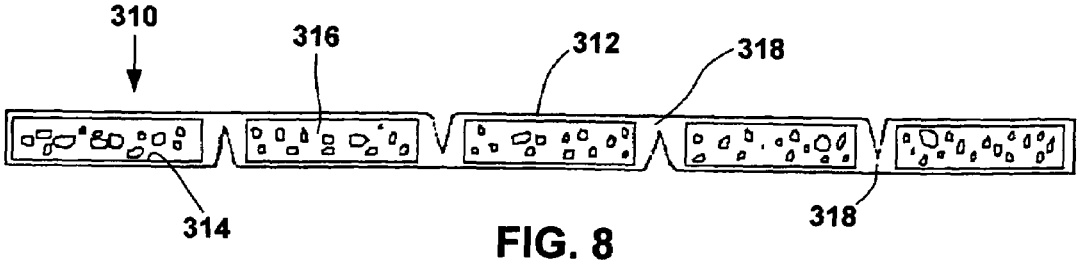
FIG. 8 is a side view of a fourth embodiment mattress in accordance with the present invention.

FIG. 8 illustrates a fourth embodiment mattress 310 in accordance with the present invention. Mattress 310 includes a flexible outer liner 312 formed from the same material as the pads 12. The liner 312 defines and surrounds a number of cavities 314 filled with a resilient cooling medium 316 like the cooling medium 18. The liner has an outer surface configured to support a sunbather lying or sitting on the mattress.

Liner portions 318 extending between the cavities are configured to enable the portions of the liner carrying the cavities 314 to be folded to place the mattress 310 in a compact configuration as previously described.

In alternative embodiments similar to the mattress 310, the liner 312 can define a single cavity extending the length of the mattress or the multiple cavities 316 can be in fluid communication with each other through the liner portions 318. These embodiments are not as preferred because the mattresses would be more difficult or impossible to fold into a compact configuration.

In yet other embodiments of the present invention the mattress includes detachable fasteners located along the sides of the mattress. This allows mattresses to be detachably connected side-to-side for assembling a wider mattress.

While I have illustrated and described preferred embodiments of my invention, it is understood that this is capable of modification, and I therefore do not wish to be limited to the precise details set forth, but desire to avail myself of such changes and alterations as fall within the purview of the following claims.

I claim:

1. A structure to form a cooling mattress for supporting and cooling a sunbather while sunbathing, the structure comprising:

a plurality of pads and a plurality of fasteners, the fasteners adapted for interconnecting the pads to one another to form the mattress;

each pad comprising a liner defining a cavity and a cooling medium deposited within the cavity, each pad comprising first and second surfaces and first and second ends, the first surface on one side of the pad for supporting a sunbather lying or sitting on the pad, the second surface on the opposite side of the pad from the first surface, the first and second ends spaced by the length of the pad, the length of the pad substantially greater than the thickness of the pad; and the pads arranged facing one another to form a stack of pads, sides of the pads being in the interior of the stack whereby the height of the stack is defined by the thickness of the pads, the height of the stack being less than the length of the mattress formed by the pads whereby the pad stack provides a compact structure for storage, chilling and transport of the pads;

wherein the fasteners permanently connect the pads together.

2. The structure of claim 1 wherein the pads are in a container.

3. The structure of claim 2 wherein the container is an insulated bag.

4. The structure of claim 2 comprising a strap attached to the container.

5. The structure of claim 1 wherein the fasteners extend between adjacent pairs of pads and each fastener is foldable to permit stacking of the adjacent pairs of pads.

6. The structure of claim 5 wherein each fastener comprises a reduced thickness portion to facilitate folding of the fastener.

7. The structure of claim 6 wherein the reduced thickness portions of adjacent fasteners are adjacent opposite sides of the pads when forming a cooling mattress.

* * * * *